US010082024B2

(12) United States Patent
Raschka et al.

(10) Patent No.: US 10,082,024 B2
(45) Date of Patent: Sep. 25, 2018

(54) TOOL SUPPORT FOR CUTTING HEADS

(71) Applicant: Caterpillar Global Mining Europe GmbH, Lünen (DE)

(72) Inventors: Joachim Raschka, Bochum (DE); Stefan Berger, Herne (DE); Jan Rohwer, Dortmund (DE); Oliver Kortmann, Werne (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 140 days.

(21) Appl. No.: 14/896,121

(22) PCT Filed: May 13, 2014

(86) PCT No.: PCT/EP2014/001288
§ 371 (c)(1),
(2) Date: Dec. 4, 2015

(87) PCT Pub. No.: WO2014/194979
PCT Pub. Date: Dec. 11, 2014

(65) Prior Publication Data

US 2017/0254199 A1 Sep. 7, 2017

(30) Foreign Application Priority Data

Jun. 6, 2013 (EP) ..... 13170924

(51) Int. Cl.
*E21C 27/24* (2006.01)
*E21C 35/18* (2006.01)
*E21C 25/06* (2006.01)

(52) U.S. Cl.
CPC ..... *E21C 35/18* (2013.01); *E21C 25/06* (2013.01)

(58) Field of Classification Search
CPC ..... E21C 35/18
See application file for complete search history.

(56) References Cited

U.S. PATENT DOCUMENTS 1,847,981 A 3/1932 Reed
3,326,307 A 6/1967 Rudy
(Continued)

FOREIGN PATENT DOCUMENTS

EP 2208856 A2 7/2010
RU 1810529 C 4/1993
(Continued)

OTHER PUBLICATIONS

International Search Report dated Jun. 8, 2015, in Patent Application No. PCT/EP2014/001287 by the European Patent Office (3 pages).

(Continued)

*Primary Examiner* — John J Kreck

(57) ABSTRACT

A replaceable tool support is disclosed. The tool support may be configured to be mounted to a base member of a cutting head, which may be mountable to a tool drum used in hard rock mining applications. The tool support may have an annular body having a first end face side. The tool support may also have a plurality of cutting bit carriers disposed spaced apart from each other on the first end face side. In addition, the tool support may have a plurality of cutting bits. Each of the plurality of cutting bits may be rotatably supported by one of the plurality of cutting bit carriers.

18 Claims, 14 Drawing Sheets

(56) References Cited

U.S. PATENT DOCUMENTS

| | | | | |
|---|---|---|---|---|
| 3,614,164 | A | 10/1971 | Davis | |
| 3,647,265 | A | 3/1972 | Pentith | |
| 4,162,104 | A | 7/1979 | Kogler et al. | |
| 4,497,520 | A * | 2/1985 | Ojanen | E21B 10/56 299/111 |
| 4,697,850 | A | 10/1987 | Tuneblom | |
| 6,003,953 | A * | 12/1999 | Huang | B28D 1/186 299/59 |
| 6,076,895 | A * | 6/2000 | Ino | E01C 23/094 299/36.1 |
| 6,343,842 | B1 * | 2/2002 | Sauer | E21B 10/10 175/373 |
| 9,803,476 | B2 | 10/2017 | Raschka et al. | |
| 2005/0146198 | A1 | 7/2005 | Hill et al. | |
| 2007/0144788 | A1 * | 6/2007 | Davis | E01C 23/06 175/331 |
| 2008/0116734 | A1 * | 5/2008 | Bechem | E21C 27/22 299/10 |
| 2008/0164073 | A1 | 7/2008 | Hall et al. | |
| 2010/0001574 | A1 | 1/2010 | Bechem | |
| 2011/0089747 | A1 | 4/2011 | Helsel et al. | |
| 2012/0001475 | A1 | 1/2012 | Dubay et al. | |

FOREIGN PATENT DOCUMENTS

| | | |
|---|---|---|
| RU | 2055184 | 2/1996 |
| SU | 848627 | 7/1981 |
| WO | WO 2012/156841 A2 | 11/2012 |
| WO | WO 2012/156842 A2 | 11/2012 |
| WO | WO 2012/156843 A2 | 11/2012 |
| WO | WO 2012/156884 A2 | 11/2012 |

OTHER PUBLICATIONS

International Search Report dated Oct. 23, 2015, in Patent Application No. PCT/EP2014/001288 by the European Patent Office (3 pages).

European Search Report dated Nov. 7, 2013, in Patent Application No. EP 13 17 0920.6 (2 pages).

European Search Report dated Nov. 7, 2013, in Patent Application No. EP 13 17 0924.8 (2 pages).

U.S. National Stage Application of Joachim Raschka et al. titled "Modular Cutting Tool," filed Dec. 4, 2015.

* cited by examiner

TOOL SUPPORT FOR CUTTING HEADS

CLAIM FOR PRIORITY

This application is a U.S. National Phase entry under 35 U.S.C. § 371 from PCT International Application No. PCT/EP2014/001288, filed May 13, 2014, which claims benefit of priority of European Patent Application No. 13170924.8, filed Jun. 6, 2013, all of which are incorporated herein by reference.

TECHNICAL FIELD

The present disclosure generally relates to a tool support for cutting heads used in hard rock mining applications, particularly to a replaceable tool support for modular cutting heads.

BACKGROUND

In hard rock mining application, it is common to use, for example, rock shearers for winning hard rock materials in a longwall, or to use, for instance, rock headers for generating a roadway in an underground mine. Both the rock shearer and the rock header may comprise at least one rotatable drum, which may be equipped with at least one cutting head being rotatable. The cutting head may be configured to support a plurality of cutting bits which are in turn configured to engage the hard rock for winning hard rock materials. The rotatable drum may be adjustable in height relative to a machine frame by a swivel arm.

The rotatable cutting head may include a cone-like shaped body having cutting bit carriers integrally formed with the body. Thus, known cutting heads may be manufactured as an integral unit, wherein worn cutting bits may be replaced by newly manufactured cutting bits. The cutting bits are rotatably and removably supported by the cutting bit carriers.

For example, EP 2 208 856 A2 discloses a cutting head having a plurality of cutting bits for wining underground materials.

US 2011/0089747 A1 relates to a cutting bit retention assembly that includes a cutting bit holder, which receives a cutting bit and has shank that extends into a bore in a support. The shank section of the cutting bit holder presents a surface defined by a notch that selectively cooperates with a retention pin.

US 2010/0001574 A1 discloses an apparatus for the milling and/or drilling cutting of materials, in particular for the removal of rock, minerals or coal, with a tool drum which is mounted on a drum carrier rotatably about a drum axis, in which a plurality of tool shafts, which carry cutting tools at their ends projecting from the tool drum, are rotatable drivable mounted, at least two of the tool shafts being drivable by a common gear drive and a common drive element.

An apparatus for the milling cutting of rock, minerals or other materials is known from WO 2012/156841A2. The disclosed apparatus includes two tool drums, which are arranged rotatably mounted side by side in twin arrangement on a drum carrier and which are respectively provided with a plurality of tool carriers which support cutting tools.

U.S. Pat. No. 3,647,265 A discloses a rotary drum-type cutting head for use with mining and tunneling machines. The cutting head includes a cylindrical drum to the periphery of which are secured a number of arcuate segments provided with pick boxes for the reception of picks.

US 2008/0116734 A1 discloses a device for milling rock or other materials. The device comprises a spindle drum which is rotatably mounted on a drum support and in which a plurality of tool spindles are received to be rotatable about spindle axes in a manner off-center of the drum. At least two of the tool spindles can be driven by a common gear drive which comprises output gears.

U.S. Pat. No. 3,326,307 A discloses a rock bit roller cone having a peripheral notch, and an annular band seated fast in said notch having a succession of radially extending cutter teeth about its peripheral surface.

Mechanically locked drill bit components are known from U.S. Pat. No. 5,906,245 A, and a cutter assembly including rotatable cutting element and a drill bit using the same are known from U.S. Pat. No. 7,762,359 B1.

The present disclosure is directed, at least in part, to improving or overcoming one or more aspects of prior systems.

SUMMARY OF THE DISCLOSURE

According to a first aspect of the present disclosure, a replaceable tool support configured to be mounted to a base member of a cutting head mountable to a tool drum used in hard rock mining applications may comprise an annular body having a first end face side, a plurality of cutting bit carriers disposed spaced apart from each other on the first end face side of the annular body, and a plurality of cutting bits rotatably supported by one of the plurality of cutting bit carriers.

According to another aspect of the present disclosure, a cutting head for hard rock mining applications may comprise a base member having a rotational axis, and a plurality of replaceable tool supports according to the present disclosure. Each of the plurality of tool supports may be concentrically disposed about the rotational axis in a releasable manner.

According to another aspect of the present disclosure, a method for replacing an annular tool support of a cutting head including a base member having a rotational axis, and a plurality of tool supports mounted about the rotational axis to the base member in a releasable manner may comprise the steps of removing at least one annular tool support having at least one worn cutting bit from the base member, and attaching a newly manufactured annular tool support having at least one new cutting bit to the base member.

According to another aspect of the present disclosure, a method for non-removably assembling a cutting bit to a cutting bit carrier of a cutting head used in underground mining applications is disclosed. The cutting bit may have a longitudinal axis about which the cutting bit is rotatable and may include a bottom portion. The cutting bit carrier may include a cutting bit carrier blind hole having an undercut section at a bottom end of the cutting bit carrier blind hole. The disclosed method for non-removably assembling a cutting bit to a cutting bit carrier may comprise the steps of heating the cutting bit to a predetermined temperature, inserting the heated cutting bit into the cutting bit carrier blind hole, such that the bottom portion of the inserted cutting bit at least partially protrudes into the undercut section, and applying a compression force to the cutting bit along the longitudinal axis for deforming the heated cutting bit, such that at least the bottom portion of the cutting bit at least partially adopts the shape of the undercut section, while still being rotatable about the longitudinal axis within the cutting bit carrier blind hole.

In some embodiments, at least one of the plurality of cutting bit carriers is integrally formed with the annular body.

In some other embodiments, the tool support may further comprise at least one tool support recess disposed at the first end face side or a second end face side of the annular body, and at least one tool support protrusion extending from the first end face side or the second end face side other than the end face side where the at least one tool support recess is disposed. In such case, the at least one tool support recess may be configured to engage at least one tool support protrusion of an adjacent tool support, and the at least one tool support protrusion is configured to engage at least one tool support recess of another adjacent tool support.

Other features and aspects of this disclosure will be apparent from the following description and the accompanying drawings.

DETAILED DESCRIPTION

Figure 1:
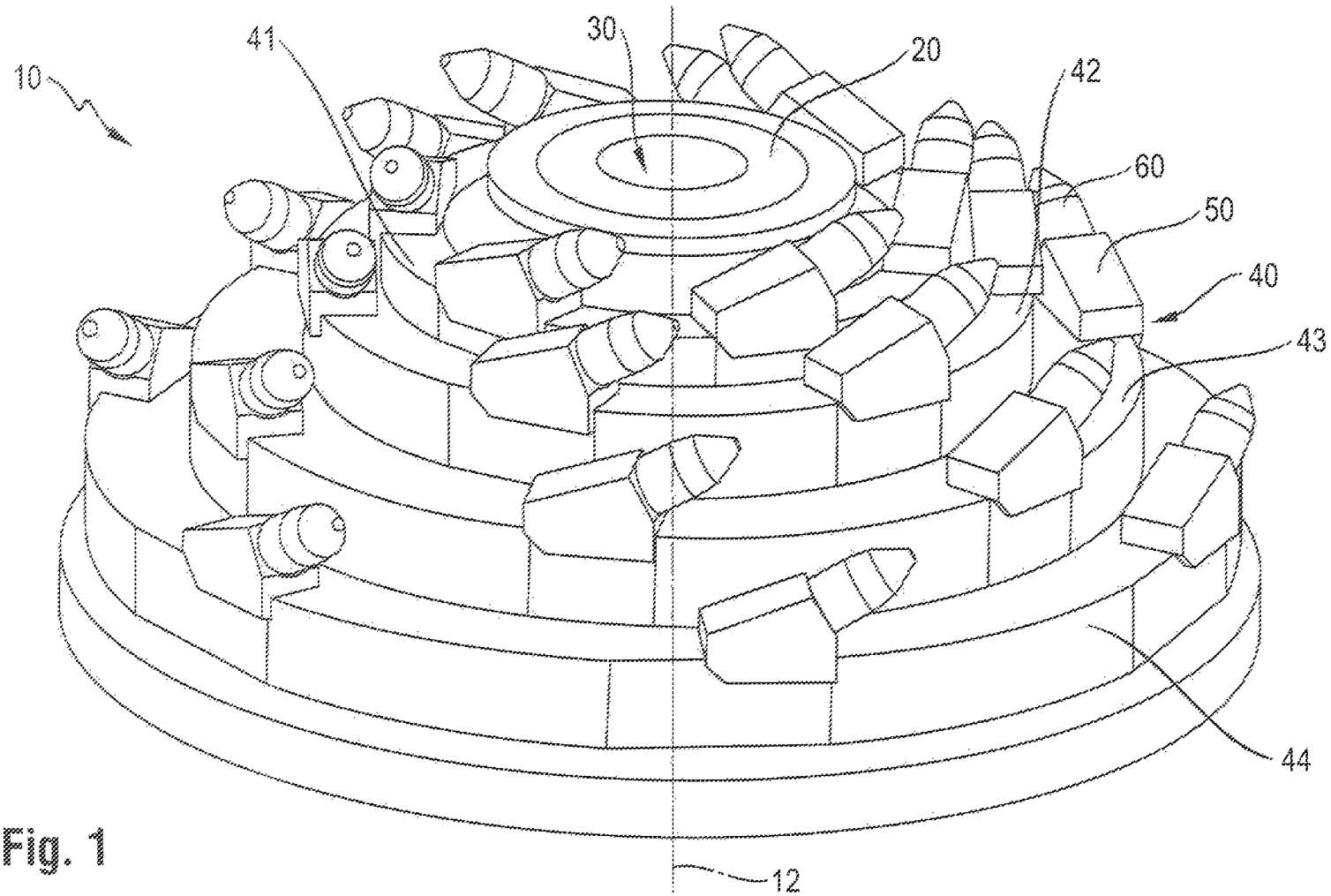
FIG. 1 is a perspective view of an exemplary disclosed modular cutting head.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure may be based in part on the realization that providing a cutting head with a modular configuration may increase the efficiency of the cutting head, as a tool support supporting worn cutting bits may be completely replaced by a new tool support supporting new cutting bits. In such case, replacement of the cutting bits may not be necessary, which may take some effort as such cutting bits may be stuck in the retention due to dirt and rock or coal pieces. Replacement of at least one complete tool support may hence reduce the downtime of the cutting machine and, thus, may reduce costs.

The present disclosure may be further based in part on the realization that providing a cutting head having a base member and a plurality of tool supports releasable mounted to the cutting head may increase the flexibility of the whole cutting head, as the plurality of tool supports supporting a plurality of cutting bits may be positioned relative to the base member as desired. Hence, for example, the base member may serve for both a dextrorotary cutting head and a levorotary cutting head, depending on the specific arrangement of the cutting bits with respect to the plurality of tool supports.

The present disclosure may be further based in part on the realization that with the exemplary disclosed modular cutting head it may be possible to provide the base member or the tool support with different appropriate materials fulfilling the requirements with respect to, for example, strength. Thus, the base member, which is exposed to less mechanical stress than, for example, the cutting bit carriers, may comprise a different material than the cutting bit carrier.

The present disclosure may be further based in part on the realization that, due to the replaceable tool supports, the cutting bits may be non-removably supported by the cutting bit carriers. This may render a retention system of removable cutting bits unnecessary and, thus, may reduce the complexity of the whole cutting head.

In the following, detailed features of the exemplary disclosed modular cutting head are described with respect to the appended drawings. Referring to FIG. 1, a perspective view of a cutting head 10 having a rotational axis 12 is illustrated. The cutting head 10 includes a base member 20, a plurality of tool supports 40, a plurality of cutting bit carriers 50 attached to the plurality of tool supports 40, and a plurality of cutting bits 60. Each of the plurality of cutting bits 60 is rotatably supported by one of the plurality of cutting bit carriers 50.

In FIG. 1 the cutting head 10 is shown with four tool supports, namely a first tool support 41, a second tool support 42, a third tool support 43, and a fourth tool support 44. The first, second, third, and fourth tool supports 41, 42, 43, 44 are concentrically disposed at the base member 20 with respect to the rotational axis 12.

Figure 2:
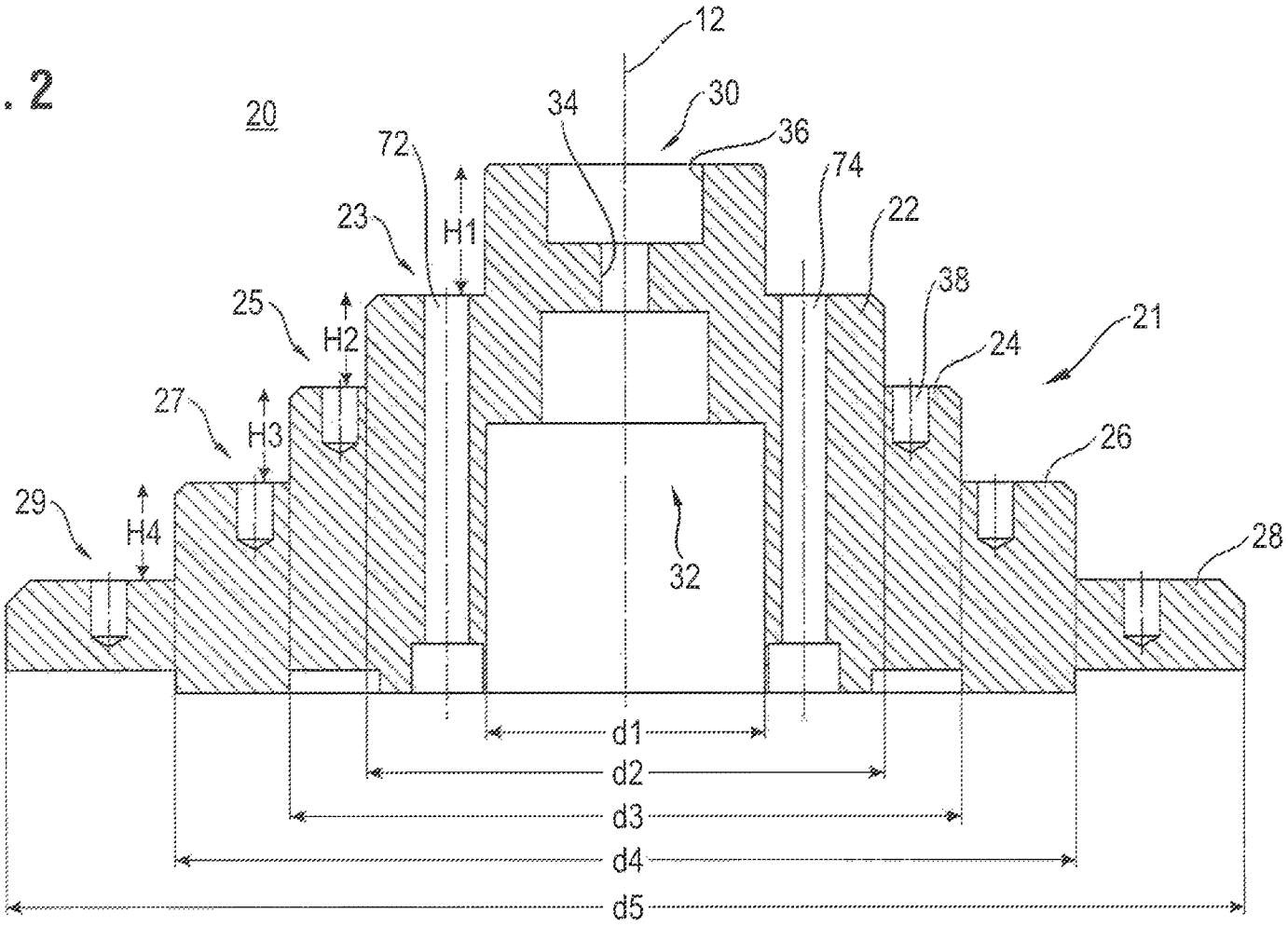
FIG. 2 is a cut view of a base member of a modular cutting head.

The base member 20 may further include a center bore 30 extending through the base member 20 along the rotational axis 12 (see also FIG. 2). The center bore 30 is configured to receive a drive bushing 31 receiving torque from a driving unit and transmitting the torque to the base member 20 and, thus, to the plurality of tool supports 40 and the plurality of cutting bits 60 configured to engage the rock.

As further shown in FIG. 1, each of the plurality of cutting bits 60 may have a specific orientation with respect to the rotational axis 12. The specific orientation of the plurality of cutting bits 60 will be described with respect to FIG. 5.

Each of the plurality of cutting bit carriers 50 is, as illustrated in FIG. 1, attached to the plurality of tool supports 40 by means of, for example, welding. In some embodiments, each or some of the plurality of cutting bit carriers 50 may be integrally formed with the plurality of tool supports 40.

Referring now to FIG. 2, a cut view of the base member 20 is illustrated in greater detail. As shown in FIG. 2, the base member 20 includes a substantially cone-like shape and provides a plurality of steps 21, namely a first step 22, a second step 24, a third step 26, and a fourth step 28. Each of the plurality of steps 21 circumferentially extend around the rotational axis 12.

The first step 22 has a first height H1, an inner diameter d1 and an outer diameter d2, thereby defining a first tool support receiving portion 23. The second step 24 has a second height H2, an inner diameter d2 and an outer diameter d3, thereby defining a second tool support receiving portion 25. The third step 26 has a third height H3, an inner diameter d3 and an outer diameter d4, thereby defining a third tool support receiving portion 27. The fourth step 28 has a fourth height H4, an inner diameter d4 and an outer diameter d5, thereby defining a fourth tool support receiving portion 29. The base member 20 comprises, therefore, a cone-like shaped stepped configuration and may be made of, for instance, grey cast iron, cast steel, or forged steel, as the base member 20 is not exposed to high mechanical stress.

Figure 3:
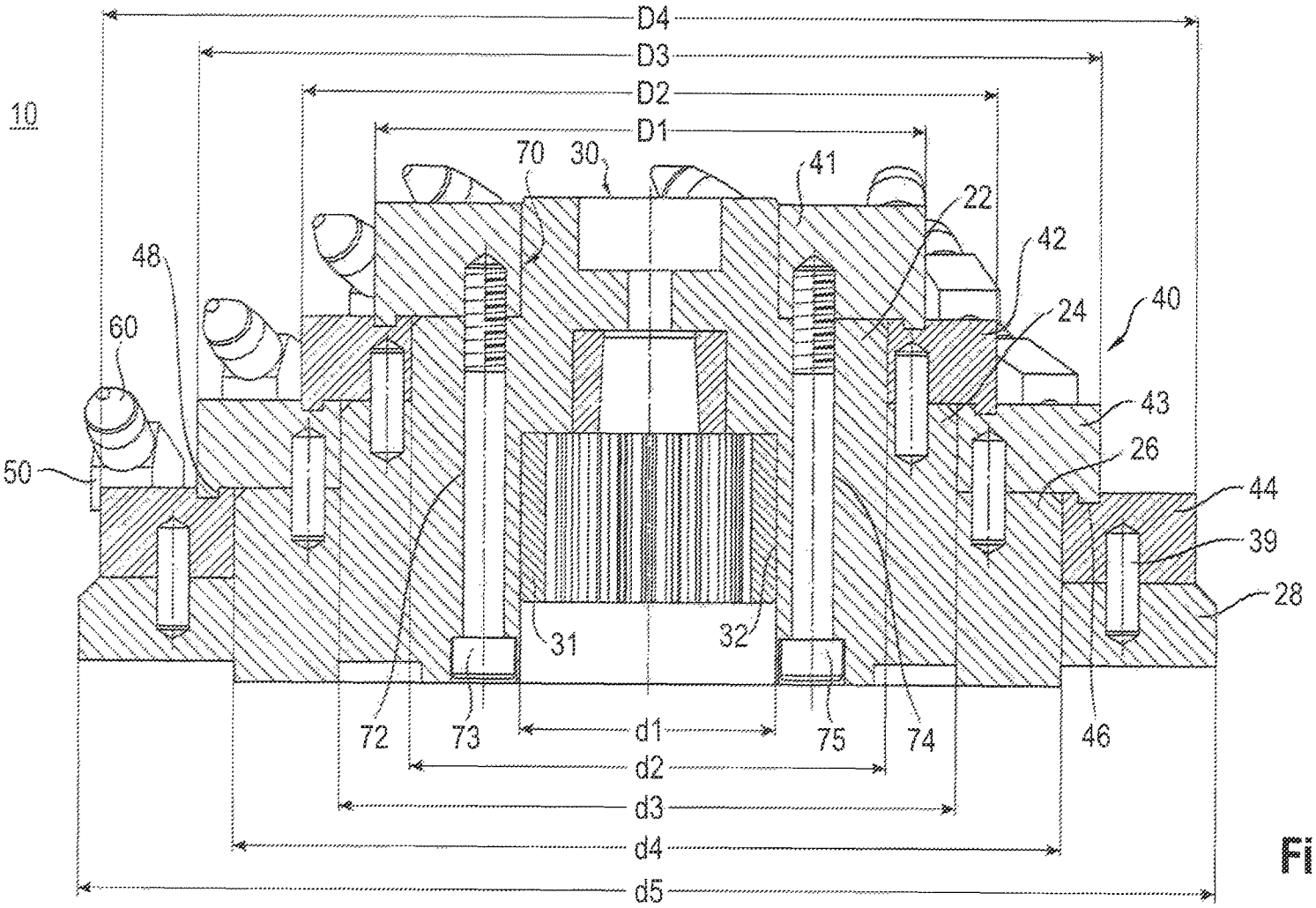
FIG. 3 is cut view of a cutting head including the base member of FIG. 2 and a plurality of replaceable tool supports according to a first embodiment.

The center bore 30 of the base member 20 includes a drive bushing receiving portion 32 configured to receive a drive bushing 31 (see FIG. 3). The drive bushing receiving portion 32 may include a bore having the first diameter d1, and a conical recess having a smaller diameter than the first diameter d1. The conical recess may be configured to center the drive bushing 31 with respect to the rotational axis 12. The drive bushing 31 is connected to a driving device (not explicitly shown in the drawings), such as, for example, an electromotor or a hydraulic motor having a gear unit, in a driving manner for driving the cutting head 10.

The drive bushing 31 is attached in the drive bushing receiving portion 32 by a press-in operation, such that the drive bushing 31 is prevented from rotating relative to the base member 20. For attaching the cutting head 10 to the driving device, a screw (not shown) may be inserted from the peak portion through an opening 34 and the screw head may be disposed in the center bore section 36.

As illustrated in FIG. 2, the drive bushing receiving portion 32 includes a stepped configuration corresponding to the stepped configuration of the drive bushing 31. The diameter of the drive bushing receiving portion 32 may correspond to the first diameter D1. However, in some embodiments, the drive bushing receiving portion 32 may include any other diameter suitable for receiving a drive bushing 31 and for transmitting torque from the driving device to the cutting head 10.

Each of the plurality of steps 21 includes at least one centering hole 38 configured to receive a pin 39 (see FIG. 3) engaging one of the plurality of tool supports 40. Particularly, as illustrated in FIG. 2, each of the plurality of steps 21 includes four centering holes 38 (two of them are shown in FIG. 2) symmetrically disposed at each step about the circumference of the base member 20.

The base member 20 further includes a first fixing bore 72 and a second fixing bore 74. Both the first fixing bore 72 and the second fixing bore 74 are configured to respectively receive a fixing device, such as, for instance, a screw engaging, for example, the first tool support 41 for fixing the same to the base member 20. However, in some embodiments, more or less than two fixing bore screws 72, 74 may be provided for fixing the plurality of tool supports 40 to the base member 20.

The base member 20 further includes an annular sealing groove 80 extending around rotational axis 12 at the bottom portion of the cutting head 10. The annular sealing groove 80 is configured to accommodate a sealing ring (not shown) for sealing the connection to the cutting machine.

With respect now to FIG. 3, a cut view of the cutting head 10 including the base member 20 of FIG. 2 and the plurality of tool supports 40 attached to the base member 20 is shown in greater detail. In FIG. 3, the first tool support 41 is disposed at the first tool support receiving portion 23 of the first step 22. The second tool support 42 is disposed at the second tool support receiving portion 25 of the second step 24. The third tool support 43 is disposed at the second tool support receiving portion 27 of the second step 24. The fourth tool support 44 is disposed at the second tool support receiving portion 29 of the fourth step 28.

Specifically, the inner diameters d1, d2, d3, d4 of the respective steps 22, 24, 26, 28 correspond to the inner diameters of the tool supports 41, 42, 43, 44, such that the each of the plurality of tool supports 40 is fixedly disposed at the respective tool support receiving portions 23, 25, 27, 29.

The outer diameter D1 of the first tool support 41 is greater than the inner diameter d2 of the second step 24, such that the first tool support 41 overlaps the second tool support 42. Similarly, the outer diameters D2 and D3 of the second and third tool supports 42 and 43, respectively, are greater than the respective inner diameters d3 and d4, such that the second tool support 42 overlaps the adjacent third tool support 43. The outer diameter D4 of the fourth tool support 44 is smaller than the diameter d5, such that the fourth tool support 44 does not axially protrude from the base member 20. In general, the outer diameter of a tool support may be greater than the inner diameter of an adjacent lower tool support, such that the upper tool support may overlap the lower tool support.

As also shown in FIG. 3, due to the overlap of adjacent tool supports, the first tool support 41 engages the second tool support 42, the second tool support 42 engages the third tool support 43, and the third tool support 43 engages the fourth tool support 44.

Figure 6:
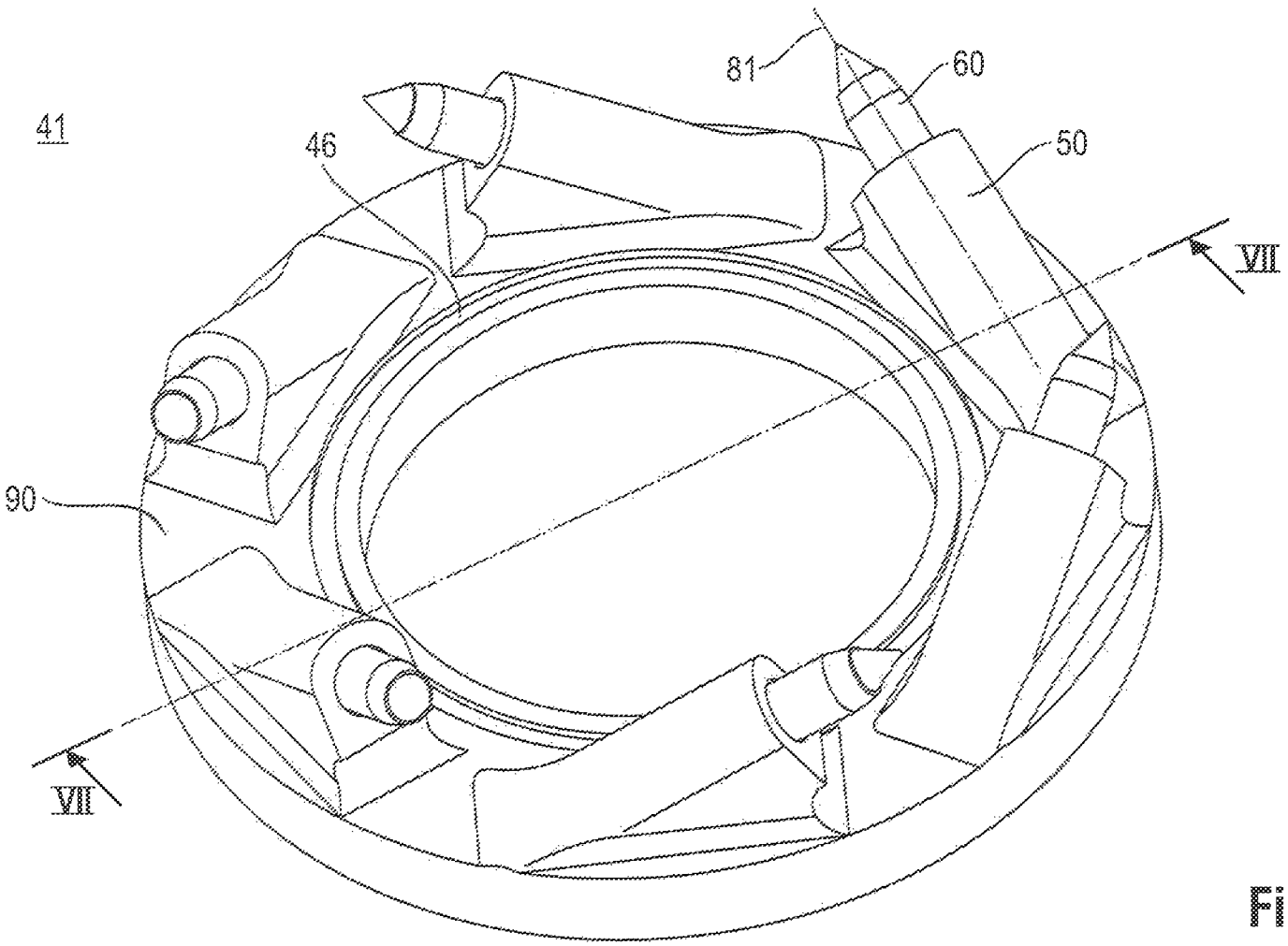
FIG. 6 is a perspective view of a tool support according to a first embodiment.
Figure 7:
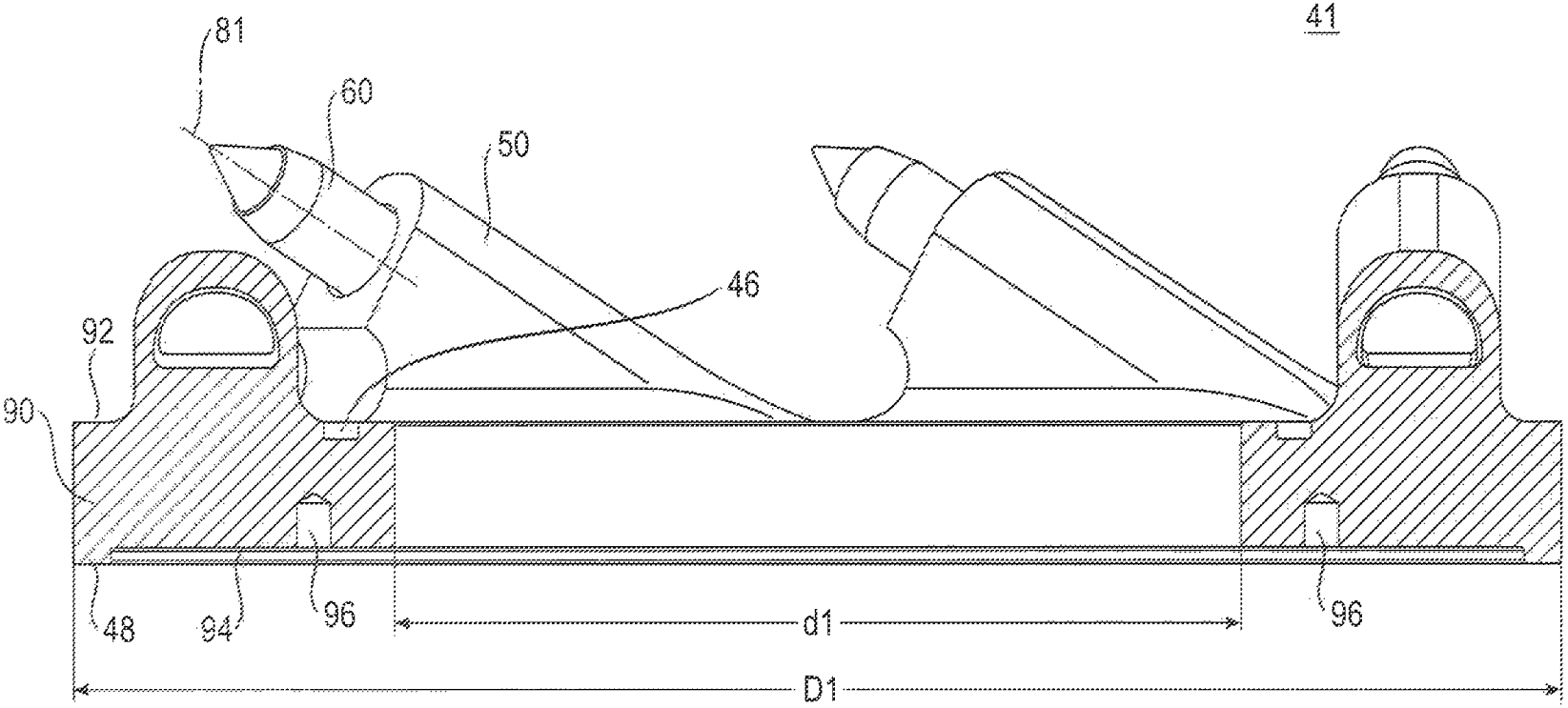
FIG. 7 is a cut view of the tool support of FIG. 6 along a line VII-VII of FIG. 6.
Figure 8:
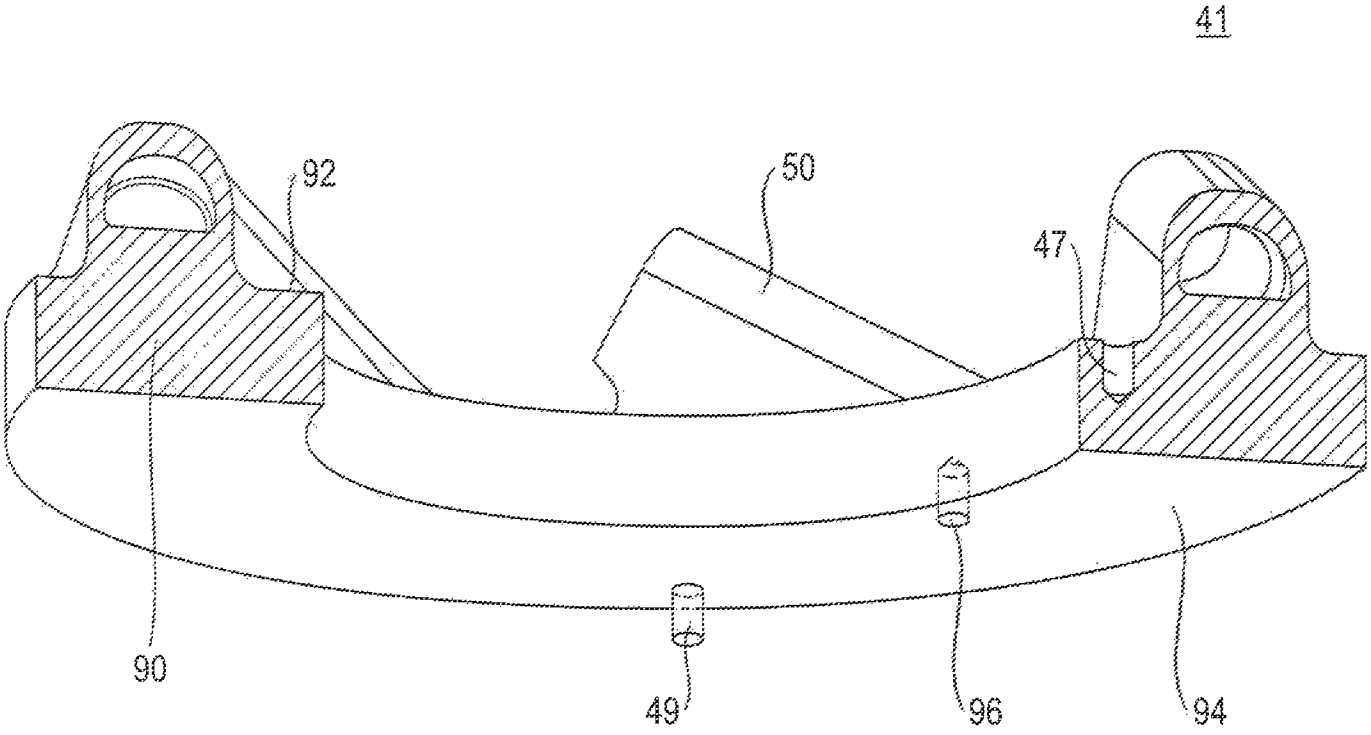
FIG. 8 is a top view of a tool support according to a second embodiment.

Particularly, each of the plurality of tool supports 40 includes at least one tool support recess 46 and at least one tool support protrusion 48. The engagement of the plurality of tool supports 40 may be described in greater detail with respect to FIGS. 6 to 8 depicted the specific configuration of an tool support in greater detail.

As shown in FIG. 3, the cutting head 10 further includes a fixing mechanism 70. In FIG. 3, the fixing mechanism 70 according to a first embodiment includes a first fixing screw 73 extending through the first fixing bore 72, and a second fixing screw 75 extending through the second fixing bore 74. Both the first fixing screw 73 and the second fixing screw 75 engage a respective thread in the uppermost tool support of the plurality of tool supports 40, which is the first tool support 41 in FIG. 3. Specifically, the uppermost tool support includes the smallest inner and outer diameter d1, D1.

Due to the plurality of overlapping tool supports 40 engaging each other, and by fastening the first and second fixing screws 73, 75, also the other tool supports, namely the second, third, and fourth tool supports 42, 43, and 44 can be fastened to the base member 20.

However, in some embodiments, the plurality of tool supports 40 may not overlap each other. In such cases, the base member 20 may include additional fixing bores. For example, the base member 20 may include two fixing bores for receiving respectively receiving f tool supports fixing screws configured to fasten each of the plurality of tool supports to the base member 20. In such cases, each of the plurality of tool supports 40 may be replaced without dismantling, for example, at least one of the tool support lying above.

The specific arrangement of the plurality of tool supports 40 to each other is defined by the pins 39. Each pin 39 may be further configured to receive and transmit any axial or radial forces from the cutting bits 60 to the base member 20, such as, for example, driving forces originating from the driving device.

Figure 4:
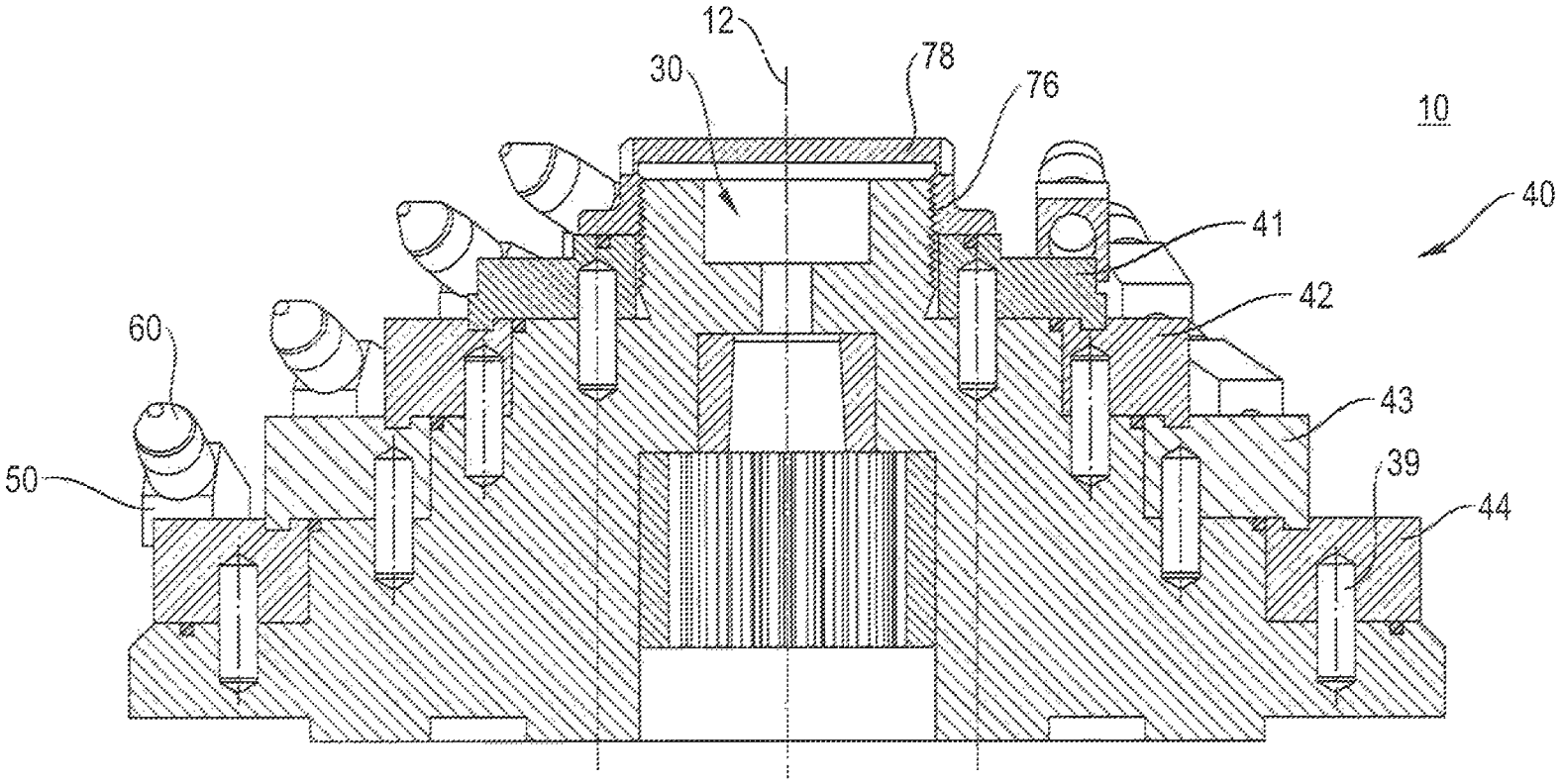
FIG. 4 is a cut view of another cutting head including a base member and a plurality of replaceable tool supports according to a second embodiment.

Referring now to FIG. 4, a second embodiment of a fixing mechanism 70 is shown in greater detail. Other components, which have been already introduced and explained with respect to FIG. 3, are provided with the same reference signs as used in FIG. 3.

The fixing mechanism 70 of FIG. 4 includes a lock nut thread 76 provided at the peak portion of the base member 20, and a lock nut 78 engaging the lock nut thread 76. The lock nut 78 contacts and secures the first tool support 41, which is the uppermost tool support and which has the smallest inner and outer diameters d1, D1 to the base member 20. Due to the overlapping tool supports 40 engaging each other, by fastening of the lock nut 78, also the other tool supports, namely the second, third, and fourth tool supports 42, 43, and 44 can be fastened to the base member 20.

In a third embodiment (not explicitly shown in the drawings), a bayonet nut connector may be used for securing the uppermost tool support to the base member 20.

Figure 5:
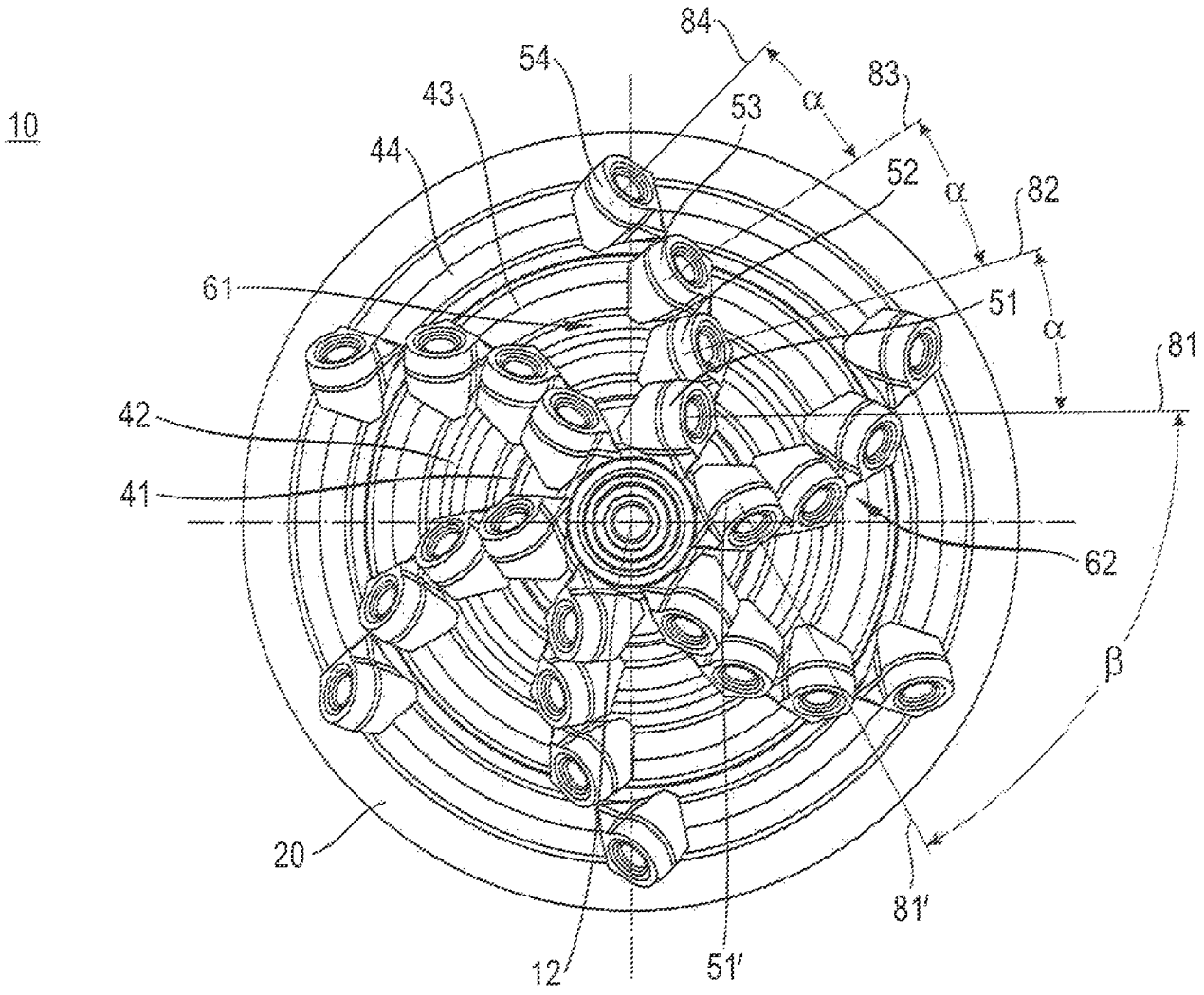
FIG. 5 is a top view of the cutting head of FIG. 1.

Referring now to FIG. 5, a top view of the cutting head 10 is shown. The cutting head 10 includes the plurality of tool supports 40. Each of the tool supports 40 includes a plurality of cutting bit carriers 50 supporting a plurality of cutting bits 60 (not explicitly shown in FIG. 5).

Specifically, the first tool support 41 includes at least one first cutting bit carrier 51, the second tool support 42 includes at least one cutting bit carrier 52, the third tool support 43 includes at least one cutting bit carrier 53, and the fourth tool support 44 includes at least one cutting bit carrier 54. Each of the plurality of cutting bit carriers 51, 52, 53, 54 are integrally formed with the respective tool support 41, 42, 43, 44 of the plurality of tool supports 40. In some embodiments, each or some of the plurality of cutting bit carriers 50 may be fixedly or releasable attached to the respective tool support of the plurality of tool supports 40.

As further illustrated in FIG. 5, each of the plurality of tool supports 40 includes six cutting bit carriers symmetrically disposed about the rotational axis 12. However, in some embodiments, each or some of the plurality of tool supports 40 may include more or less than six cutting bit carriers 50, which may also be symmetrically or, in some cases, asymmetrically disposed about the rotational axis 12.

The plurality of cutting bit carriers 50 and, thus, the plurality of cutting bits 60 are arranged to each other as illustrated in FIG. 5. Specifically, the plurality of cutting bit carriers 50 are divided into six groups of cutting bit carriers. Two of the six groups of cutting bit carriers, namely a first group of cutting bit carriers 61 and a second group of cutting bit carriers 62, are described in the following in greater detail. However, the same features described with respect to the first and second group of cutting bit carriers 61, 62 may similarly apply to the other groups of cutting bit carriers.

As shown in FIG. 5, the first group of cutting bit carriers 61 comprises the cutting bit carrier 51 including a longitudinal axis 81, the cutting bit carrier 52 including a longitudinal axis 82, the cutting bit carrier 53 including a longitudinal axis 83, and the cutting bit carrier 54 including a longitudinal axis 84. In particular, the longitudinal axes 81, 82, 83, 84 may also be longitudinal axes of respective cutting bits supported by the cutting bit carriers 51, 52, 53, 54.

The first longitudinal axis 81 may form an angle $\alpha$ with the second longitudinal axis 82. Similarly, the second longitudinal axis 82 may also form the angle $\alpha$ with the third longitudinal axis 83, and the third longitudinal axis 84 may also from the angle $\alpha$ with the fourth longitudinal axis 84. The angle $\alpha$ may range, for example, from about 10° to about 20°.

However, in some embodiments, the angles between the first, second, third, and fourth longitudinal axes 81, 82, 83, 84 may not be identical and, hence, may be different angles.

Further, an angle $\beta$ is formed between the longitudinal axis 81 of the cutting bit carrier 51 of the first group of cutting bit carriers 61 and the longitudinal axis 81' of the cutting bit carrier 51' of the second group of cutting bit carriers 62. The angle $\beta$ may range, for example, from about 50° to about 70°. In some embodiments, in case that the plurality of cutting bit carriers 50 is symmetrically disposed at each of the plurality of tool supports 40, the angle $\beta$ may be 360°/n, where n is the number of cutting bits at the respective tool support.

It should be noted that the number of cutting bit carriers may also vary between the plurality of tool supports 40. For example, the first tool support 41 may include six cutting bit carriers and, thus, six cutting bits, whereas the second tool support 42 may include more or less than six cutting bit carriers and, thus, more or less than six cutting bits.

With respect to FIGS. 6 to 9, an exemplary embodiment of a tool support, for example, the first tool support 41 is described in greater detail. As already described above, the first tool support 41 includes six cutting bit carriers 50. However, in some embodiments, the first tool support 41 may also include more or less than six cutting bit carriers 50.

Referring to FIG. 6, a perspective view of the first tool support 41 is shown. The tool support 41 includes an annular body 90 and a plurality of cutting bit carriers 50 each supporting one of a plurality of cutting bits 60. Each of the plurality of cutting bits 60 is rotatably supported by one of the plurality of cutting bit carriers 50. As indicated in FIG. 6, the tool support 41 includes a tool support recess 46, such as, for example, a tool support groove circumferentially extending around the annular body 90.

With respect to FIG. 7, a cut view of the first tool support 41 along line VII-VII of FIG. 6 is illustrated. As shown, the annular body 90 includes a first end face side 92, a second end face side 94 opposite to the first end face side 92, an outer lateral surface and an inner lateral surface. The first end face side 92 faces towards the peak portion (see, for example, FIG. 2) of the substantially cone-like shaped base member 20, whereas the second end face side 94 faces to the opposite side of the peak portion. According to the present disclosure, the plurality of cutting bit carriers 50 are attached to the first end face side 92. As shown in FIG. 7, the plurality of cutting bit carriers 50 are integrally formed with the annular body 90 at the first end face side 92.

The annular body 90 includes a substantially rectangular cross-section. However, in some embodiments, the annular body 90 may include any other suitable cross-sectional shape, such as, for example, a circular cross-section, an oval-cross section or a square cross-section.

The tool support recess 46, as shown in FIG. 7 as a groove extending circumferentially around the annular body 90, is also disposed at the first end face side 92. The tool support recess 46 is inwardly disposed with respect to the plurality of symmetrically arranged cutting bit carriers 50.

Furthermore, as depicted in FIG. 7, the tool support 41 also includes the tool support protrusion 48, which extends from the second end face side 94. The tool support protrusion 48 is shown in FIG. 7 as an annular collar extending circumferentially around the annular body 90 at its outermost end. Thus, the tool support protrusion 48 is outwardly disposed with respect to the plurality of symmetrically arranged cutting bit carriers 60.

The tool support 41 further includes at least one bore 96 configured receive the pin 39 (see FIG. 3) and to be aligned with the at least one centering hole 38 of the base member 20 when the tool support 41 is positioned at the respective tool support receiving portion 23 at first step 22 (see FIG. 2).

It should be noted that the locations of the tool support recess 46 and the tool support protrusion 48 may also be different to the configuration as shown in FIG. 7. For instance, the tool support recess 46 may be disposed at the second end face side 94, whereas the tool support protrusion 48 may be disposed at the first end face side 92. Further, independently from the above, the tool support recess 46 may be outwardly disposed with respect to the plurality of symmetrically arranged cutting bit carriers 60, whereas the tool support protrusion 48 may be inwardly disposed with respect to the plurality of symmetrically arranged cutting bit carriers 60.

With respect to FIG. 3, the tool support protrusion 48 of the tool support 41 is configured to engage the tool support recess of the second tool support 42, as the first at tool support 41 at least partially overlaps the second tool support 42. Thus, the shape of the tool support protrusion 48 may correspond to the shape of the respective tool support recess accommodating the tool support protrusion 48.

The configuration of the tool support recess 46 and the tool support protrusion 48 engaging each other is not limited to the configuration as illustrated in FIG. 7. For example, at least one tool support recess 47 in FIG. 8 may be constituted by a bore, and at least one tool support protrusion 49 may be constituted by a pin protruding from the second end face side 94. The locations of the respective tool support recess 47 and the tool support protrusion 49 may be defined by the desired orientation of the plurality of cutting bit carriers 50 and the plurality of cutting bits 60.

As also indicated in FIG. 8, the tool support 41 also includes the already above-mentioned bore 96 for receiving the pin 39.

Figure 9:
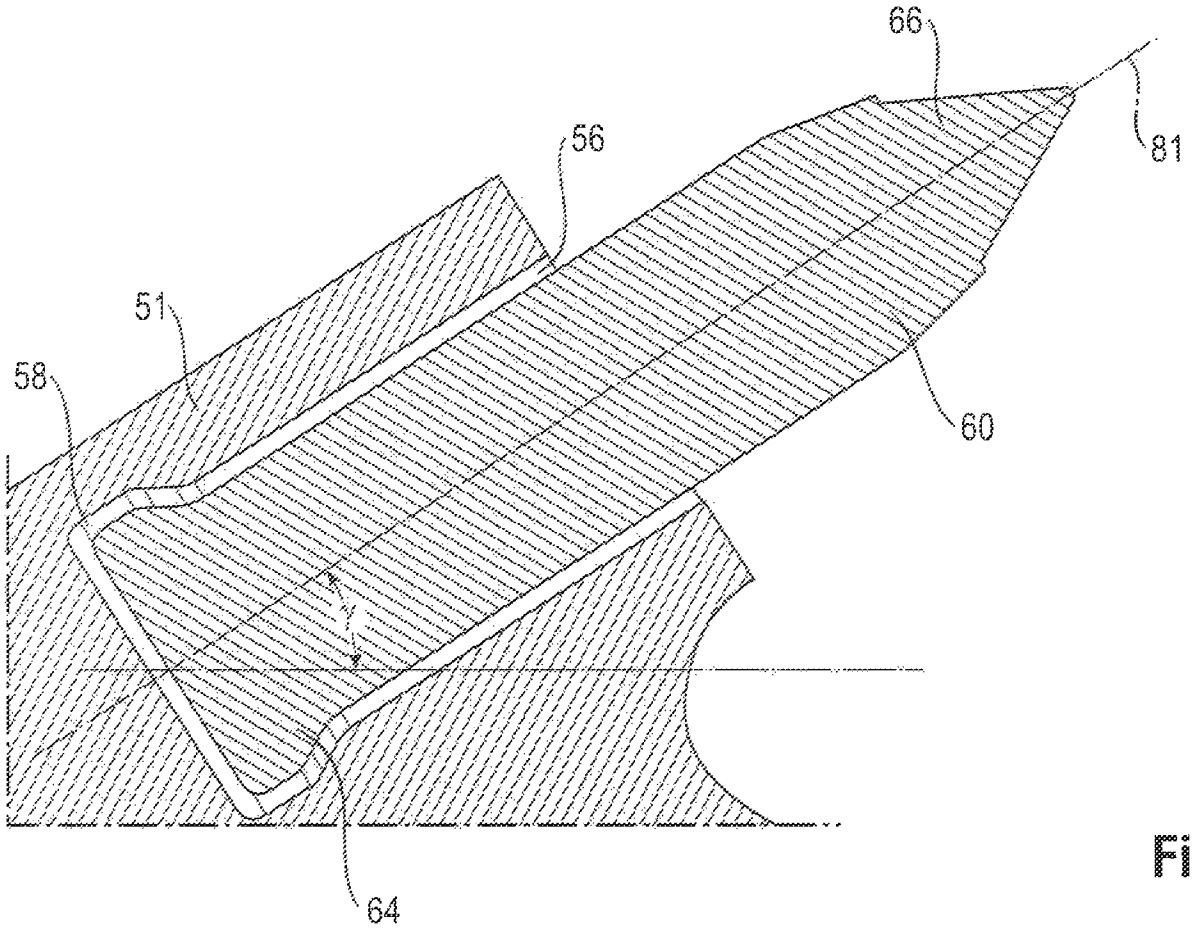
FIG. 9 is a cut view of a cutting bit carrier integrally formed with a tool support and supporting a rotatable cutting bit.

Referring now to FIG. 9, one of the plurality of cutting bit carriers 50, for example, the cutting bit carrier 51 of FIG. 5, is illustrated in greater detail. The cutting bit carrier 51 rotatably supports a cutting bit 60 in a cutting bit carrier blind hole 56. Thus, the diameter of the cutting bit 60 may be substantially smaller than the diameter of the cutting bit carrier blind hole 56.

The cutting bit carrier blind hole 56 may also include an undercut section 58 disposed at a bottom portion of the cutting bit carrier blind hole 56, which means at the deepest portion of the cutting bit carrier blind hole 56. The cutting bit 60 includes a bottom portion 64 and a cutting portion 66 configured to engage the material to be extracted.

The cutting bit 60 may be non-removably supported by the cutting bit carrier 51, such that the cutting bit 60 includes a widened diameter at its bottom portion substantially corresponding to the undercut section 58. Therefore, the cutting bit 60 is prevented from disengaging the cutting bit carrier 51, which means from falling out of the cutting bit carrier blind hole 56. But it should be again noted, that the cutting bit 60 is still rotatably supported by the cutting bit carrier 51.

As also shown in FIG. 9, the rotational axis of the cutting bit 60 may form an angle $\gamma$ with a flat surface of the respective step (indicated by the horizontal dash-dot-line in FIG. 9) of the base member 20. The angle $\gamma$ may be in a range from, for example, about 20° to 45°.

In the following an exemplary process for assembling the cutting bit 60 to the cutting bit carrier 51 may be described in detail. First, the cutting bit 60 initially including a substantially cylindrical shape may be heated to a predetermined temperature suitable for mechanically deforming the cutting bit 60. Then, the bottom portion 64 of the cutting bit 60 is introduced into the cutting bit carrier blind hole 56, such that the bottom portion 64 at least partially protrudes into the undercut section 58. Preferably, the bottom portion 64 is introduced into the cutting bit carrier blind hole 58 until the bottom portion 64 of the cutting bit 60 reaches the deepest point of the cutting bit carrier blind hole 56, particularly the deepest point of the undercut section 58.

By applying a compression force onto the cutting bit 60 in the direction along the longitudinal axis 81, the bottom portion 64 of the cutting bit 60 may be deformed until the bottom portion 64 at least partially adopts the shape of the undercut section 58. Thus, the cutting bit 60 is non-removably mounted to the cutting bit carrier 51, while still being rotatable about the longitudinal axis 81. Each of the plurality of tool supports 40 may be comprised of, for instance, high-tensile steel withstanding high mechanical stress.

FIGS. 10 to 15 illustrate a further exemplary embodiment of a modular cutting head 110. It is explicitly stated that the features described with respect to FIGS. 1 to 9 do also at least partially apply to the embodiment shown in FIGS. 10 to 15, where appropriate.

Figure 10:
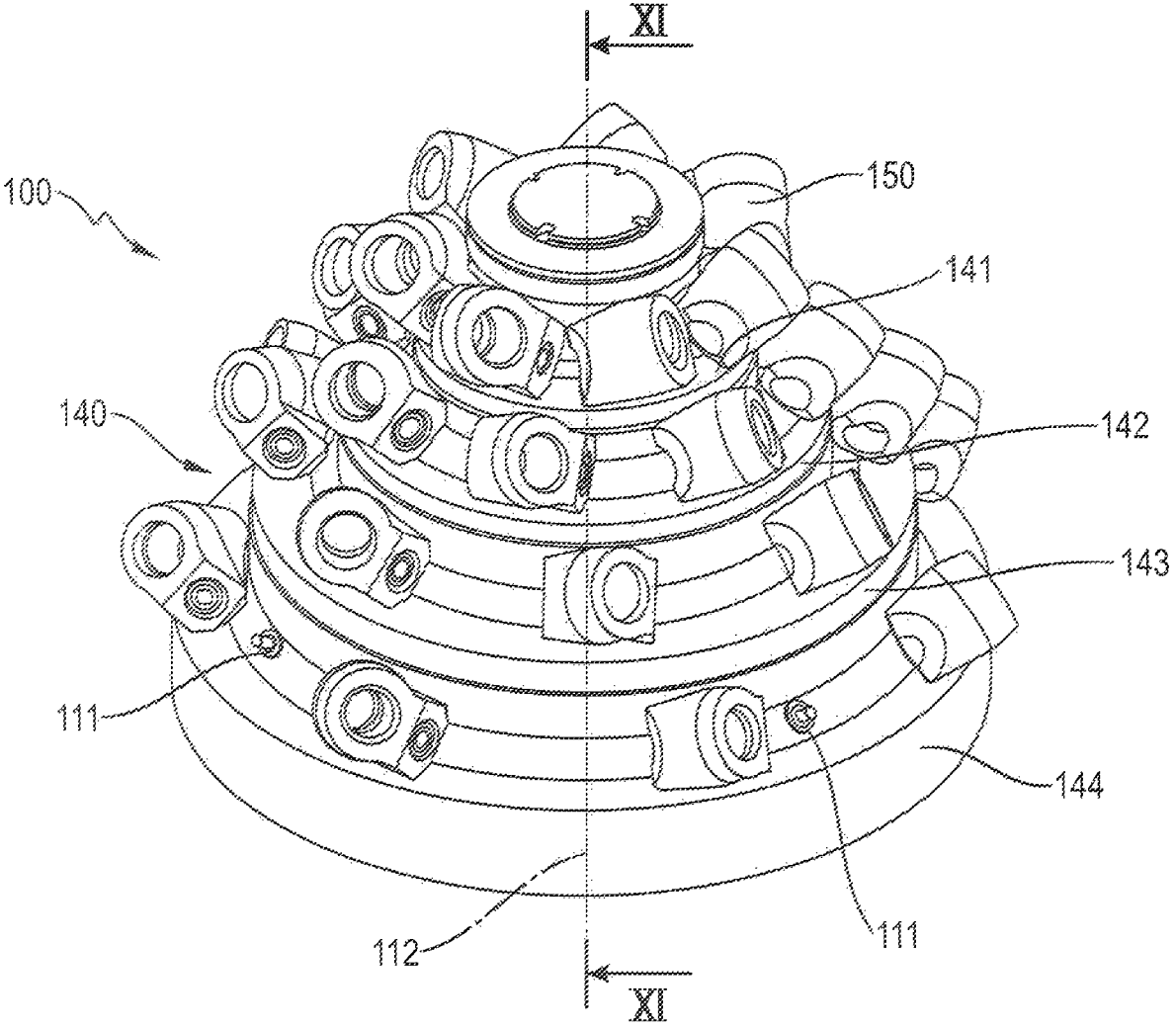
FIG. 10 is a perspective view of a further exemplary modular cutting head.

Referring to FIG. 10, a perspective view of a further modular cutting head 110 having a rotational axis 112 is illustrated. The cutting head 110 includes a base member 120 (see FIGS. 11 to 13), a plurality of tool supports 140, a plurality of cutting bit carriers 150 attached to the plurality of tool supports 140, and a plurality of cutting bits (not shown). Each of the plurality of cutting bits is rotatably supported by one of the plurality of cutting bit carriers 150.

In FIG. 10 the cutting head 110 is shown with four tool supports, namely a first tool support 141, a second tool support 142, a third tool support 143, and a fourth tool support 144. The first, second, third, and fourth tool supports 141, 142, 143, 144 are concentrically disposed about the rotational axis 112 and attached to the base member 120. However, the modular cutting head 110 may include less or more than four tool supports 140.

As further indicated in FIG. 10, the cutting head 110 includes at least one grease nipple 111 attached to, for example, the fourth tool support 144. The at least one grease nipple 111 is configured to provide lubricating means, such as grease or the like, into an intermediate space formed between a tool drum (not shown in the drawings) to which the cutting head 110 is mounted and the rotating cutting head 110, which will be described in detail below.

Figure 11:
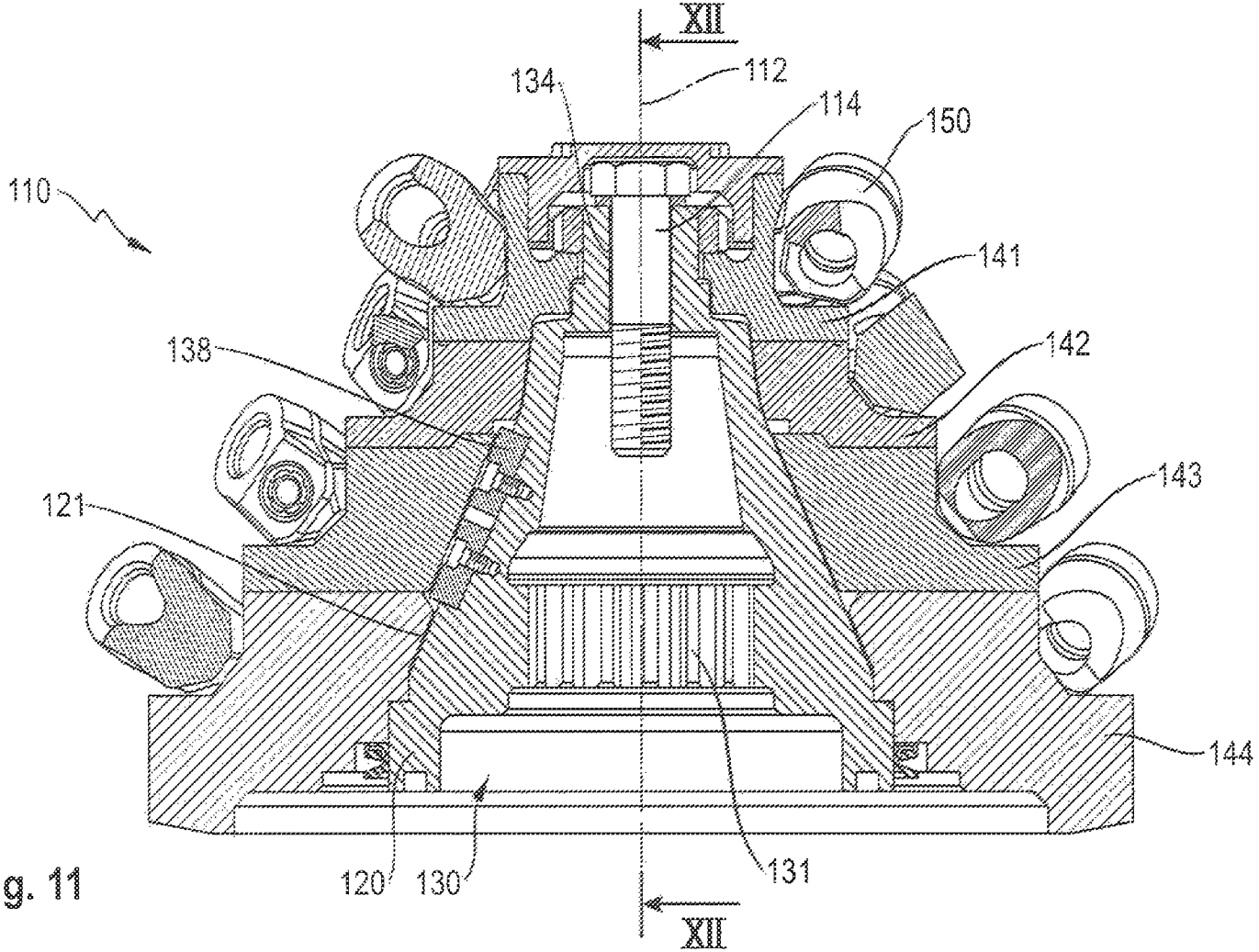
FIG. 11 is a cut view of the modular cutting head of FIG. 10 taken along line XI-XI of FIG. 10.

Referring to FIG. 11, a cut view of the cutting head 110 of FIG. 10 taken along line XI-XI of FIG. 10 is illustrated. The base member 120 may include a center bore 130 extending through the base member 120 along the rotational axis 112. The center bore 130 includes a drive bushing 131 receiving torque from a driving unit and transmitting the torque to the base member 120 and, thus, to the plurality of tool supports 140 and the plurality of cutting bits configured to engage the rock.

As further shown in FIG. 11, each of the plurality of cutting bits may have a specific orientation with respect to the rotational axis 112. The specific orientation of the plurality of cutting bits is shown and described with respect to FIG. 5.

Each of the plurality of cutting bit carriers 150 is, as illustrated in FIG. 11, attached to the plurality of tool supports 140 by means of, for example, welding. In some embodiments, each or some of the plurality of cutting bit carriers 150 may be integrally formed with the plurality of tool supports 140.

The base member 120 includes a substantially cone-like shape and provides a conical lateral surface 121 embodying a contact surface for the tool supports 140. Each of the inner portions of the annular tool supports 141, 142, 143, 144 substantially corresponds to the outer diameter of the cone-like shaped base member 120 at the respective axial position with respect to the rotational axis 112. The annular tool supports 140 will be described in greater detail with respect to FIGS. 14 and 15.

The center bore 130 of the base member 120 includes drive bushing 131 integrally formed with the base member 120. However, similarly to the base member 20 of FIG. 2, the base member 120 may also include a drive bushing receiving portion configured to receive a separately formed drive bushing 131. The drive bushing receiving portion may then be configured as described with respect to the drive bushing receiving portion 32 of FIG. 2.

For attaching the cutting head 110 to the driving device, a screw 114 may be inserted from the peak portion through an opening 134. The screw 114 may be received by a corresponding thread (not shown) formed in the driving device also engaging the drive bushing 131.

The cutting head 110 further includes an anti-rotation mechanism configured to prevent relative movement between at least one tool support 140 and the base member 120, especially to prevent rotationally movement between at least one tool support 140 and the base member 120. For example, the anti-rotation mechanism includes at least one feather key 138 attached to the lateral surface 121 of the base member 120. As exemplarily shown in FIG. 11, the feather key 138 is fixed to the base member 120 via, for example, at least one screw. However, in further examples, the at least one feather key 138 may be fixed to the base member via, for instance, welding, gluing, or other fixing means. In some embodiments, the at least one feather key 138 may be integrally formed with the base member 120.

Figure 13:
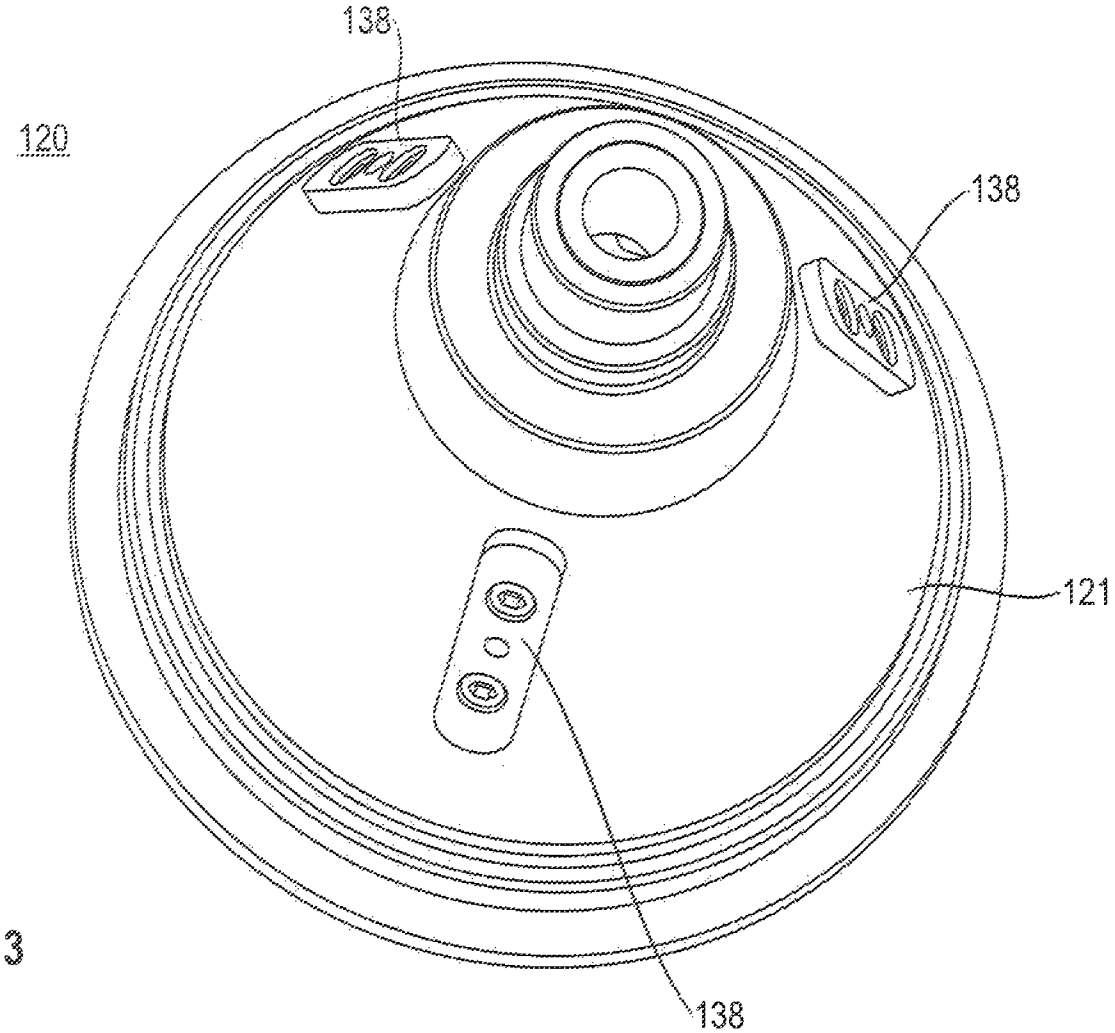
FIG. 13 is a perspective view of a base member of the modular cutting head of FIG. 10.

In the exemplary embodiment described herein, three feather keys 138 are symmetrically attached to the base member 120 about the circumference of the lateral surface 121 at the same axial position in relation to the rotational axis 112 (see particularly FIG. 13). In some embodiments, there may be less or more than three feather keys 138 disposed about the circumference of the lateral surface 121. In some further embodiments, the feather keys 138 may be provided at different axial positions with respect to the rotational axis 112.

In the preferred embodiment, the at least one feather key 138 is attached to the base member 120 such that its longitudinal axis intersects with the rotational axis 112. Thus, the at least one feather key 138 having a generally rectangular shape substantially extends from top to bottom along the lateral surface 121. In some embodiments, the at least one feather key 138 may be obliquely attached at the lateral surface 121 such that the at least one tool support 140 engaging the feather key 138 may be partially screwed onto the base member 120.

The at least one feather key 138 is configured to engage at least one tool support 140 for preventing relative movement between the base member 140 and the at least one tool support 140. As illustrated in FIG. 11, the feather key 138 engages the third tool support 143 such that the third tool support 143 is locked in the circumferential direction and, hence, prevented from rotation relative to the base member 120.

Figure 12:
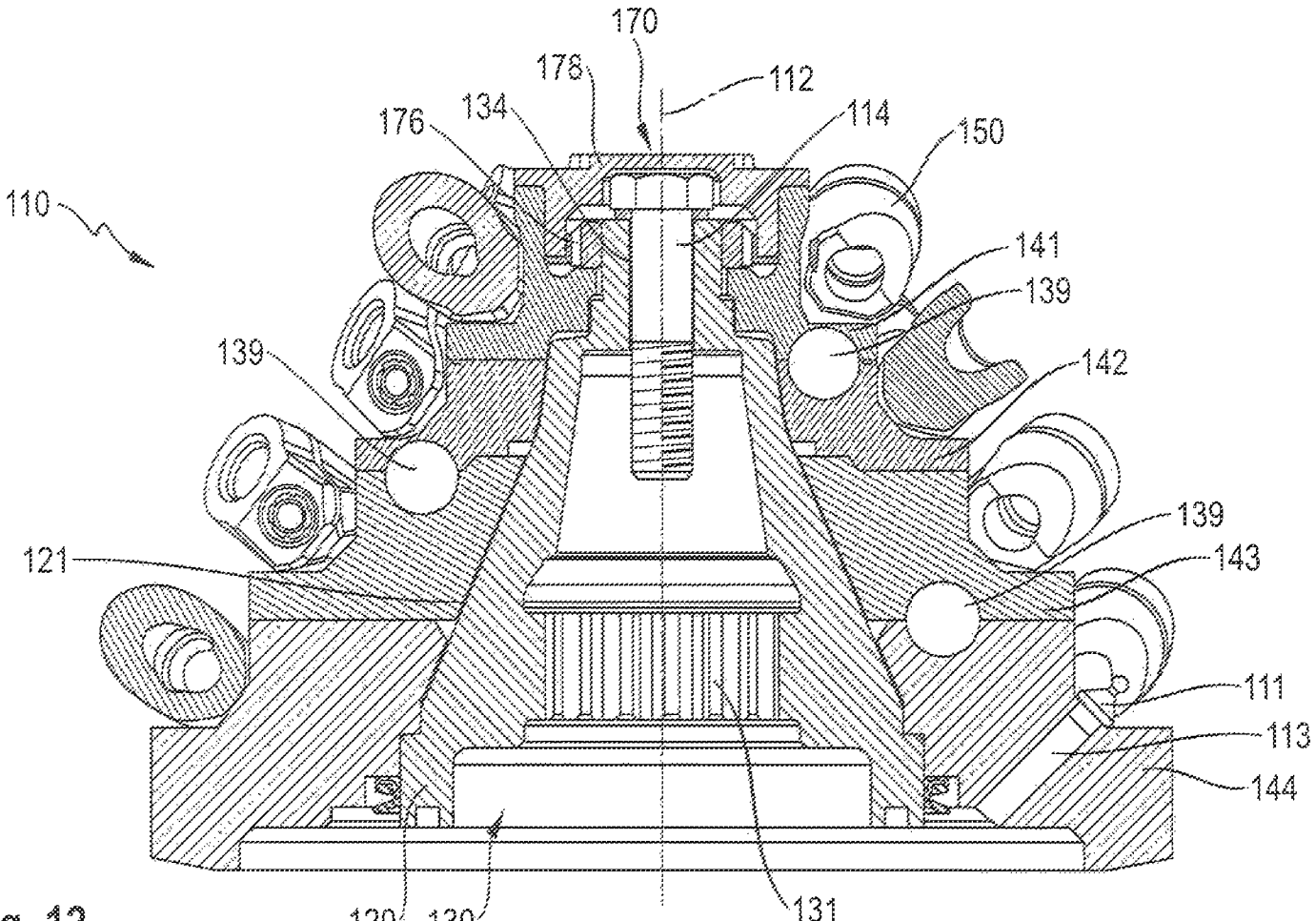
FIG. 12 is a cut view of the modular cutting head of FIG. 10 taken along line XII-XII of FIG. 11.

Referring to FIG. 12, a cut view taken along line XII-XII of FIG. 11 is shown. As shown in FIG. 12, the anti-rotation mechanism further includes a plurality of locking elements 139 disposed at the interfaces between the respective tool supports 141, 142, 143, 144. The locking elements 139 are configured to prevent relative movement between two adjacent tool supports 140. In the exemplary embodiment shown in FIG. 12, three locking elements 139 substantially in the form of balls are provided at each interface between two adjacent tool supports 140. In some other example, there may be less or more than three locking elements 139 provided at each interface between two adjacent tool supports 140.

By providing the anti-rotation mechanism including at least one feather key 138 in combination with at least one locking element 139 at the respective interfaces between two adjacent tool supports 140, the tool supports 140 are prevented from rotational movement relative to the base member 120. Thus, proper operation of the cutting head 110 may be ensured.

The locking elements 139 are not limited to the form of balls as shown in FIG. 12. In some embodiments, the locking elements 139 may include any suitable shape for preventing relative rotational movement between adjacent tool supports 140, such as, for example, a cuboid, a polygon, or a pyramid.

The locking elements 139 are inserted in corresponding locking recesses 196 formed in the first and second end face sides 192, 194 of the annular tool supports 140 (see FIGS. 14 and 15), which means that the locking elements 139 are not fixedly attached to one of the respective tool supports 140.

As also illustrated in FIG. 12, the grease nipple 111 is fixed to a grease nipple bore 113 provided at the fourth tool support 144 and extending obliquely in relation to the rotational axis 112. The grease nipple 111 is configured to provide grease into the intermediate space between the center bore 130 and the outside. Thus, the grease may work as, for instance, a dirt guard preventing any dirt, such as coal matter, from getting from the outside into the center bore 130, which would affect proper operation of the cutting head 110.

Similarly to the embodiments of FIGS. 3 and 4, the cutting head 110 also includes a fixing mechanism 170, which is similar to the fixing mechanism 70 of FIG. 4. The fixing mechanism 170 of FIG. 12 includes a lock nut thread 176 provided at the peak portion of the base member 20, and a lock nut 178 engaging the lock nut thread 176.

A perspective view of an exemplary base member 120 is shown in FIG. 13. As can be seen in FIG. 13, the three feather keys 138 are symmetrically disposed about the circumference of the lateral surface 121.

Figure 15:
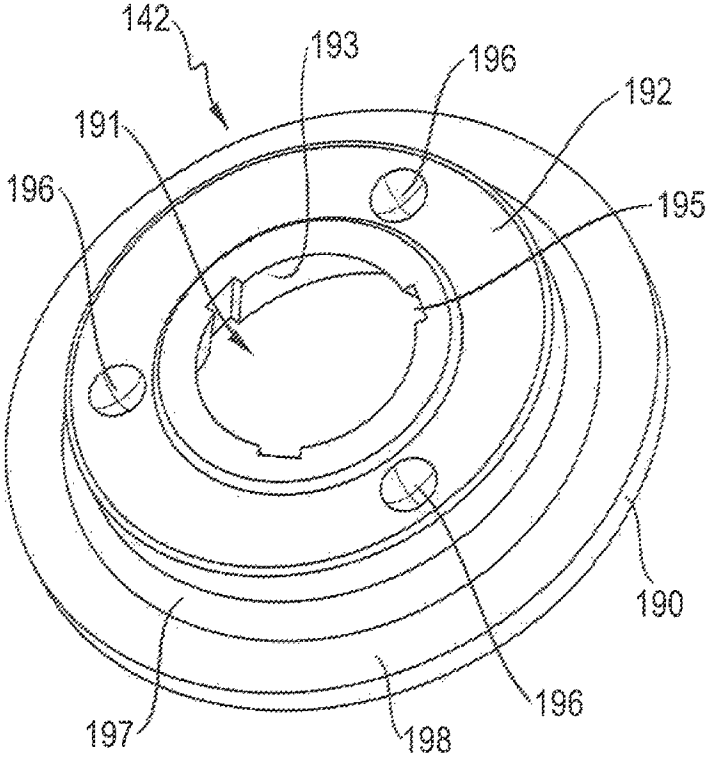
FIG. 15 is further perspective view of the tool support of FIG. 14.
Figure 14:
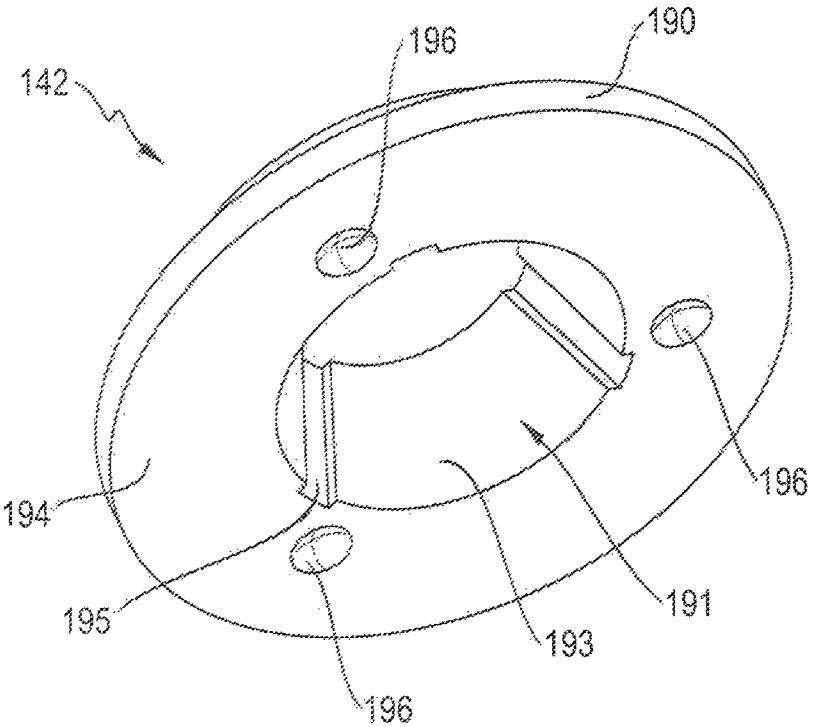
FIG. 14 is a perspective view of a tool support according to a further embodiment.

Referring to FIGS. 14 and 15, two perspective views of an exemplary tool support 140 is illustrated. Specifically, for the sake of exemplification, FIGS. 14 and 15 show perspective views of the second tool support 142. However, the features described with respect to the tool support 142 may similarly apply to the tool supports 141, 143, 144 differing in dimensions with respect to the inner and outer diameters.

The tool support 142 includes an annular body 190 and a plurality of cutting bit carriers 150 (not explicitly shown in FIGS. 14 and 15) each supporting one of a plurality of cutting bits. The annular body 190 includes a first end face side 192, a second end face side 194 opposite to the first end face side 192, an outer lateral surface portion including an angular face 107, and an inner lateral surface 193. The first end face side 192 may be the upper end face side remote to the tool drum, whereas the second end face side 194 may be the lower end face side facing towards the tool drum.

The annular tool support 142 includes an inner portion 191 providing a cone-shaped lateral inner surface 193 substantially corresponding to the lateral surface 121 of the base member 120 at the respective axial position with respect to the rotational axis 112. The lateral surface 193 includes at least one feather key groove 195 configured to match with the at least one feather key 138. Specifically, the quantity of feather key grooves 195 corresponds to the quantity of feather keys 138. In the exemplary embodiment shown in FIGS. 14 and 15, three feather key grooves 195 symmetrically disposed at the inner portion 193 are provided. The feather key grooves 195 are oriented such that its orientation substantially corresponds to the orientation of the feather key 138. Thus, the longitudinal axes of the feather key grooves 195 intersect with the rotational axis 112 of the base member 120.

In some embodiments, in case that the feather keys 138 are obliquely oriented, the feather key grooves 138 may correspondingly be obliquely oriented such that the tool support 142 may be at least partially screwed onto the base member 120 for matching the feather key grooves 195 to the feather keys 138.

At the first end face side 192, the annular body 190 includes at least one locking recess 196 substantially corresponding to the at least one locking element 139. In the embodiment shown in FIGS. 14 and 15, there are three locking recesses 196 provided as substantially hemispherical recesses 196 formed in the annular body 190 at the first end face side 192 (see FIG. 15). Similarly, there are three locking recesses 196 also provided as substantially hemispherical recesses 196 formed in the annular body 190 at the second end face side 194 (see FIG. 14). In some embodiments, the locking recesses 196 may have another shape substantially corresponding to the shape of the locking elements 139.

With the tool supports 141, 142, 143, 144 mounted to the base member 120, at least the feather key grooves 195 of the third tool support 143 engage the feather keys 138, such that rotational movement of at least the third tool support 143 relative to the base member 120 is locked. By further providing the plurality of locking elements 139 inserted in the plurality of locking recesses 196, rotational movements between adjacent tool supports 140 are further prevented. Thus, a defined orientation and position of the tool supports 140 with respect to one another and with respect to the base member 120 is achieved.

Similarly to FIG. 7, each of the tool supports 140 may include a tool support protrusion 48, such as, for instance, an annular collar, and a tool support recess 46, such as, for example, an annular groove (not shown in FIGS. 14, and 15). The tool support protrusion 48 and the tool support recess 46 are formed at the first and second end face sides 92, 94, respectively, and configured to respectively match with a tool support protrusion 48 and a tool support recess 46 of an adjacent tool support 140.

The plurality of cutting bit carriers 150 are attached to the annular body 190 at, for instance, an angular face 197. In some embodiments, the plurality of cutting bit carriers 150 may be attached to the annular body 190 at the planar angular surface 198.

In other exemplary embodiments, the stepped base member 20 of FIGS. 1 to 4 may also include at least one feather key attached to the base member 20 or integrally formed therewith. Specifically, the feather keys may then be vertically provided at one of the steps. In such embodiments, the annular tool supports 40 may include, similarly to the annular tool supports 140 of FIGS. 14, and 15, at least one feather key groove at its inner lateral surface that corresponds to the feather key, such that rotational movement between the base member 20 and the at least one tool support 40 is prevented.

INDUSTRIAL APPLICABILITY

In the following, an exemplary operation of the exemplary disclosed cutting head 10 is described with respect to FIGS. 1 to 15.

During operation, a rotatable cutting drum including at least one exemplary disclosed cutting head 10, 110 may rotate each of the at least one cutting head 10, 110 for winning rock, coal, or mineral materials in an underground mine. Specifically, a driving device transmits torque to the cutting head 10, 110 via the drive bushing 31, 131. As the plurality of cutting bits 60 are rotatably supported by the plurality of cutting bit carriers 50, 150, the engaging time of the cutting bits 60 with, for example, the rock is short, which may reduce the mechanical stress to the cutting bits 60.

However, after a certain time, and due to the continues mechanical stress, the cutting bits 60 may be worn, such that they need to be replaced by new cutting bits 60. With the exemplary disclosed modular cutting head 10, 110, it is possible to completely replace an tool support supporting worn cutting bits 60.

In the case of, for example, worn cutting bits 60 at the third tool support 43, 143, the fixing screws 73, 75 are loosened such that the first and second tool supports 41, 42, 141, 142 may be removed from the base member 20, 120. Then, the third tool support 43, 143 is replaced by a new tool support supporting new cutting bits 60. Subsequently, the first and second tool supports 41, 42, 141, 142 are positioned on the base member 20, 120 and fixed to the base member 20, 120 by fastening the fixing screws 73, 75.

In some embodiments, the cutting bits 60 may be removably supported by the cutting bit carriers 50, 150. In such case, instead of separately replacing worn cutting bits 60, it may be possible to replace the respective tool support with another tool support supporting new cutting bits. Then, while the cutting machine is operating again, the worn cutting bits 60 of the removed tool support may be replaced with new cutting bits 60. This may reduce the downtime of the cutting machine, as replacing a complete tool support may require less time than replacing each worn cutting bit. Therefore, the efficiency of the cutting machine may be increased.

Although the preferred embodiments of this invention have been described herein, improvements and modifications may be incorporated without departing from the scope of the following claims.

The invention claimed is:

1. A replaceable tool support configured to be mounted to a base member of a cutting head mountable to a tool drum used in hard rock mining applications, the tool support comprising:

an annular body having a first end face side;

a plurality of cutting bit carriers disposed spaced apart from each other on the first end face side;

a plurality of cutting bits, each of the plurality of cutting bits being rotatably supported by one of the plurality of cutting bit carriers;

at least one tool support recess disposed at one of the first end face side and a second end face side of the annular body, the second end face side being opposite to the first end face side; and a first tool support protrusion extending from an other of the first end face side and the second end face side, wherein the at least one tool support recess is configured to engage a second tool support protrusion of an adjacent tool support, and the first tool support protrusion is configured to engage at least one tool support recess of another adjacent tool support.

2. The tool support of claim 1, further comprising at least one tool support recess disposed at the first end face side or at a second end face side of the annular body, the second end face side being opposite to the first end face side.

3. The tool support of claim 1, further comprising at least one tool support protrusion extending from the first end face side or a second end face side of the annular body, the second end face side being opposite to the first end face side.

4. The tool support of claim 1, wherein at least one of the plurality of cutting bit carriers is integrally formed with the annular body.

5. The tool support of claim 1, wherein the tool support recess is disposed at the first end face side, and the first tool support protrusion is disposed at the second end face side.

6. The tool support of claim 1, wherein the tool support recess is inwardly disposed with respect to the plurality of cutting bit carriers in a radial direction, and the first tool support protrusion is outwardly disposed with respect to the plurality of cutting bit carriers in a radial direction.

7. The tool support of claim 1, wherein the tool support recess is an annular groove extending about the circumference of the annular body.

8. The tool support of claim 1, wherein the first tool support protrusion is an annular collar extending about the circumference of the annular body.

9. The tool support of claim 1, wherein the plurality of cutting bits are axially secured to the plurality of cutting bit carriers.

10. The tool support of claim 1, wherein the annular body includes an inner lateral surface having a conical shape.

11. The tool support of claim 1, further comprising at least one feather key groove provided at an inner lateral surface of the annular body, the at least one feather key groove being configured to match with a feather key attached at the base member.

12. The tool support of claim 1, further comprising at least one locking element recess provided at one of the first end face side and a second end face side of the annular body, the at least one locking element recess being configured to match with a locking element.

13. A cutting head for hard rock mining applications, comprising:

a base member having a rotational axis;

a plurality of replaceable tool supports according to claim 1 concentrically disposed about the rotational axis in a releasable manner, each replaceable tool support comprising:

an annular body having a first end face side;

a plurality of cutting bit carriers disposed spaced apart from each other on the first end face side; and a plurality of cutting bits, each of the plurality of cutting bits being rotatably supported by one of the plurality of cutting bit carriers.

14. The cutting head of claim 13, wherein the plurality of replaceable tool supports comprises different diameters.

15. The cutting head of claim 13, wherein the base member has a substantially cone-like shape having a peak portion with a first diameter (d1) and a second portion with a second diameter (d5), the first diameter (d1) being smaller than the second diameter (d5).

16. A method for replacing an annular tool support according to claim 1 of a cutting head including a base member having a rotational axis, and a plurality of annular tool supports mounted about the rotational axis to the base member in a releasable manner, the method comprising the steps of:

removing at least one annular tool support having at least one worn cutting bit from the base member; and attaching a newly manufactured annular tool support having at least one new cutting bit to the base member.

17. The cutting head of claim 13, wherein at least one of the plurality of cutting bit carriers is integrally formed with the annular body.

18. The cutting head of claim 13, further comprising:

at least one tool support recess disposed at one of the first end face side and a second end face side of the annular body, the second end face side being opposite to the first end face side; and a first tool support protrusion extending from an other of the first end face side and the second end face side other than where the at least one tool support recess is disposed, wherein the at least one tool support recess is configured to engage a second tool support protrusion of an adjacent tool support, and the first tool support protrusion is configured to engage at least one tool support recess of another adjacent tool support.

* * * * *